United States Patent [19]

Barnes et al.

[11] Patent Number: 4,460,003

[45] Date of Patent: Jul. 17, 1984

[54] COIN PRESENCE SENSING APPARATUS

[75] Inventors: Elwood E. Barnes, Parkesburg; Thomas L. Flack, Philadelphia, both of Pa.

[73] Assignee: Mars, Inc., McLean, Va.

[21] Appl. No.: 294,997

[22] Filed: Aug. 21, 1981

[51] Int. Cl.[3] ..... G07F 3/02

[52] U.S. Cl. ..... 133/1 R; 133/8 R; 194/100 A

[58] Field of Search ..... 133/1 R, 1 A, 3, 8 R, 133/8 A, 8 B, 8 C, 8 D; 194/100 A, 100 R, 97 A; 324/229, 236; 336/221, 225; 331/18

[56] References Cited

U.S. PATENT DOCUMENTS

| | | | |
|---|---|---|---|
| 3,020,750 | 2/1962 | Briscoe | 73/67.2 |
| 3,163,818 | 12/1964 | Spaven | 324/57 |
| 3,242,932 | 3/1966 | Becker | 133/8 R |
| 3,453,532 | 7/1969 | Gardiner | 324/3 |
| 3,599,771 | 8/1971 | Hinterstocker | 194/100 A |
| 3,743,853 | 7/1973 | Dittman et al. | 336/83 X |
| 3,870,137 | 3/1975 | Fougere | 194/100 A |
| 4,254,857 | 3/1981 | Levasseur et al. | 194/100 A |
| 4,286,703 | 9/1981 | Schuller et al. | 194/100 A |
| 4,286,704 | 9/1981 | Wood | 194/100 A |

FOREIGN PATENT DOCUMENTS

| | | | |
|---|---|---|---|
| 951403 | 7/1974 | Canada . | |
| 82140 | 9/1952 | Czechoslovakia . | |
| 101356 | 2/1961 | Czechoslovakia . | |
| 105631 | 11/1962 | Czechoslovakia . | |
| 1591996 | 2/1973 | Fed. Rep. of Germany . | |
| 1575609 | 6/1969 | France | 331/18 |
| 2020469 | 11/1979 | United Kingdom . | |

OTHER PUBLICATIONS

Millman and Taub, *Pulse and Digital Circuits,* Section 2-8, pp. 52-57, (1956).

Terman, *Electronic and Radio Engineering,* Sections 2.7, 3.1, and 3.2, (4th Ed., 1955).

Carniol, B., Measuring Physical Quantities by Evaluating the Free Running Damped Oscillations of a Measuring Circuit, *Tesla Electronics, Quarterly Review of Czeckoslovak Electronics and Telecommunications,* vol. 1, pp. 35 to 41, 1968.

Carniol, B., Evaluation of Free Oscillation Damping and Delivered Calibration Curves, *Tesla Electronics, Quarterly Review of Czeckoslovak Electronics and Telecommunication,* vol. 4, pp. 41-50, 1971.

Carniol, B., Die Mebgroben-Trennung bei der Induktiven Dickenmessung mit Dampfungsauswertung von Eigenschwingungen, *Messtechnik,* pp. 284-289, (12/71).

Carniol, B., Eine Neue Schaltung fur die Beruhrungslose Dickenmessung mit Impulserregten L-C Mebkreisen, *Messtechnik,* pp. 199-206, 7/72.

Digital Q Meter QDM, *News from Rohde and Schwartz,* vol. 10, No. 45, pp. 20-22, 1970.

*Primary Examiner*—Joseph J. Rolla

*Attorney, Agent, or Firm*—Davis, Hoxie, Faithfull & Hapgood

[57] ABSTRACT

A coin presence sensing apparatus comprises one or more ringing electronic oscillator circuits at least some of which include an inductor having a dumbbell shaped core adjacent a coin passageway. A pulse generating circuit is provided to selectively pulse each oscillator circuit. After the oscillator is pulsed, it begins to oscillate. Coin proximity during the time the oscillating circuit oscillates is determined by comparing the output of the oscillating circuit with the output of an oscillating circuit having a reference inductor isolated from coins.

23 Claims, 11 Drawing Figures

COIN PRESENCE SENSING APPARATUS

FIELD OF THE INVENTION

The present invention relates to a coin presence sensing apparatus for use in a coin handling mechanism.

BACKGROUND OF THE INVENTION

In the field of coin handling mechanisms, many uses for coin presence sensing apparatus exist. One such use is to monitor coin storage tube level. It is well known in the art that where a coin mechanism stores coins in a coin tube for purposes of change making, it is beneficial to monitor the level of coins in the coin tube (coin tube level). Typically, when the number of coins in a coin tube becomes too few for change making purposes, an exact change light is turned on. When a coin tube becomes full, coin path jamming may be minimized by diverting coins directly to a cash box rather than allowing them to pass to the coin tube. Electromechanical switches have been used to monitor the level of coins in a coin tube; however, such switches may require cleaning and can malfunction by jamming. Optical sensing devices have also been employed, but these are subject to performance degradation due to dirt and component aging. Inductors comprising coils wrapped around the coin tube have also been used, but these have several disadvantages. They interfere with the opening of the coin tube for cleaning and removal of jammed coins, and they are subject to outside influences such as coins in an adjoining coin tube.

A second use of coin presence sensing apparatus is to provide a means for determining when a coin passes a particular location in the coin vending mechanism. One way that coin passage has been established in prior art apparatus is by placing an electromechanical switch so that it will be actuated by a passing coin, or by establishing a light beam which crosses the coin path and which will be interrupted by a passing coin.

The use of inductors as coin presence sensors in coin mechanisms is well known. The inductor is usually a part of an electrical resonant circuit. When a coin or other electrically conductive or magnetic object is in the field created by the inductor, changes in inductance and energy loss can occur. The resulting shifts in frequency or amplitude of the resonant circuit, or both, are electrically detected to provide a signal indicating the presence or absence of a coin.

The conventional measure of inductor energy loss is called the quality factor or Q. The Q of a resonant circuit is its inductive reactance divided by its equivalent series resistance. This is commonly expressed by the formula: $Q=2\pi\ fL/R$ where f is the frequency, L is the inductance and R is the resistance of the circuit. Another way of defining circuit Q is $2\pi$ times the energy stored in the circuit divided by the energy dissipated in the circuit during one cycle. See Terman, *Electronic and Radio Engineering,* sections 2.7, 3.1 and 3.2 (4th Ed. 1955).

A ringing circuit is a resonant circuit whose oscillations are started by a pulse and continue after the removal of the pulse. For this reason, such circuits are sometimes called shock-excited circuits. Once activated in this fashion, the ringing circuit will continue to oscillate at its resonant frequency, but the amplitude of oscillation decreases as energy is lost. A well known way to measure the Q of a resonant circuit is to connect it as a ringing circuit and count the number N of cycles until the amplitude of oscillation decreases to 1/e of its initial value where the natural log of e is one and e is approximately 2.718. The Q of the circuit is equal to $2\pi N$. See Millman & Taub, *Pulse and Digital Circuits,* Sections 2–8, pp. 52–57 (1956); U.S. Pat. Nos. 3,163,818 and 3,020,750.

A well known object examining technique in both coin discriminating and metal detecting apparatus is to measure the energy loss of an oscillator in an inductive sensor circuit in the presence of the object by measuring the effect on Q of the object's presence in the field of the sensor. See, for example, Canadian Pat. No. 951,403 and U.S. Pat. No. 3,453,532. It is also well known to measure Q by counting the cycles of a ringing circuit. See, for example, U.S. Pat. Nos. 3,163,818 and 3,020,750 and *News from Rohde & Schwartz,* vol. 10, no. 45 (1970). Until recently, however, ringing circuits with counters to measure energy loss have been relatively expensive as compared with other coin sensing circuits. Among the reasons for this relative expense were the need for both analog and digital circuits, the degree of stability of the analog circuits necessary to provide a stable threshold for terminating counting and the relative complexity of digital circuits. In particular, such circuits have been too expensive for use where merely the presence or absence of coins must be detected, for example, in determining the contents of coin storage tubes. Electromechanical switches, optical sensors together with various detection circuits have been more practical for economic reasons. These, however, often have their own problems and, in many cases are not as well suited to use with the digital control circuits of modern coin mechanisms.

SUMMARY OF THE INVENTION

The present invention provides a coin presence sensor circuit of the ringing circuit pulse counting type in which the coin sensor is an inductor designed to direct its detection field so that the field is generally parallel to the coin face when a coin is present, thereby reducing extraneous influences. In preferred embodiments, the pulse counts from the coin sensor inductors are compared with the pulse counts from an inductor of the same type which is subject to the same environmental conditions as the coin sensor inductors, but remote from the influence of coins.

One specially designed inductor has a dumbbell shaped core which can be more particularly described as having two faces connected by a central core extending perpendicularly between the two faces. The two faces and the connecting central core are cylindrical in the preferred embodiment. The central core is wound with a copper winding. The two faces have a diameter larger than the diameter of a cylinder defined by the central core and the copper winding. This shape is beneficial to creating a magnetic field projecting into the regions at the ends of the inductor. By placing a face of the inductor at the appropriate level adjacent to a coin tube in a coin vending mechanism, an electromagnetic field is created generally parallel to the face of stacked coins at the inductor level and an indication of coin tube presence at that level may be obtained by detecting the interaction of coins with the field. Similarly by placing an appropriate inductor adjacent to a coin passageway in a coin vending mechanism so that its field is generally parallel to the faces of passing coins, an indication of coin passage by the point at which the inductor is positioned may be obtained.

Further features of the invention, its nature, and various advantages will be more apparent upon consideration of the attached drawings and the following detailed description of the invention.

Although coin selector apparatus constructed in accordance with the principles of this invention may be designed to identify and accept any number of coins from the coin sets of many countries, the invention will be adequately illustrated by explanation of its application to identifying the U.S. 5-, 10-, and 25-cent coins. The figures are intended to be representational and are not necessarily drawn to scale. Throughout this specification the term "coin" is intended to include genuine coins, tokens, counterfeit coins, slugs, washers, and any other item which may be used by persons in an attempt to use coin-operated devices. Furthermore, from time to time in this specification, for simplicity, coin movement is described as rotational motion; however, except where otherwise indicated, translational and other types of motion also are contemplated. Similarly, although specific types of logic circuits are disclosed in connection with the embodiments described below in detail, other logic circuits can be employed to obtain equivalent results without departing from the invention. Component values are exemplary for the embodiments discussed in the specification.

DETAILED DESCRIPTION

Figure 1:
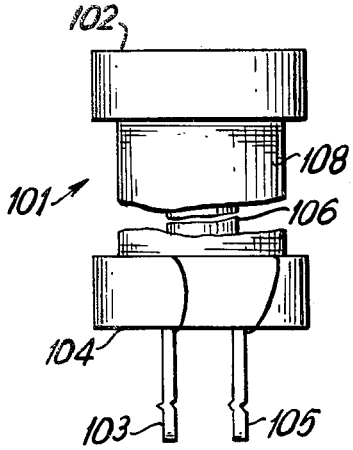
FIG. 1 illustrates a dumbbell-shaped inductor for use in accordance with our invention.

FIG. 1 shows an inductor comprising a coil wound on a dumbbell shaped core which is used in the first and second embodiments of coin presence sensing apparatus according to the invention. The inductor 101 has faces 102 and 104 which are connected by a central core 106. The central core is wound with a coil of copper wire 108 which connects to leads 103 and 105. Leads 103 and 105 are used to connect the inductor to the rest of the coin sensing apparatus. The faces 102 and 104 have diameters larger than the diameter of a cylinder defined by the central core 106 and the copper winding 108.

In these embodiments of our invention, the inductor has a ferrite core which is random wound with approximately 450 turns of No. 38 AWG copper wire. The overall length of the core is 12/32 of an inch. The length of the central core is 6/32 of an inch. The diameter of the inductor faces is 9/32 of an inch and the diameter of the central core is 3/32 of an inch. A suitable ferrite core for the inductor of these embodiments is Tomita's type DRW $8\times10$.

When current flows through the coil 108 of the inductor 101, a magnetic field is projected primarily in a direction perpendicular to the faces 102 and 104 of the inductor. A coin passing through or stopped within the projected magnetic field interacts with the field and thus affects the current flowing in the inductor 101. This interaction is detected by associated circuits as indicative of coin passage or coin proximity to the inductor.

Figure 2:
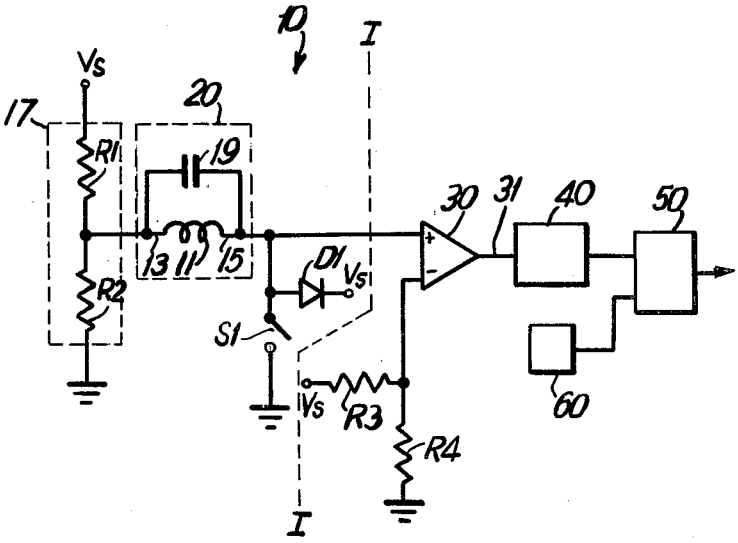
FIG. 2 shows a schematic block diagram of a first illustrative embodiment of our invention.

FIG. 2 is a schematic block diagram of a circuit 10 for a first illustrative embodiment of a coin presence sensing apparatus according to the invention. The circuit 10 includes an inductor 11 which corresponds to inductor 101 of FIG. 1. A capacitor 19 is connected in parallel with the inductor 11 to form the resonant oscillator circuit 20. One lead 15 of the inductor 11 is connected to the + input of an analog comparator 30, to supply voltage $V_s$ through diode D1, and to ground through switch S1. The other lead 13 of inductor 11 is at a reference voltage level determined by the supply voltage $V_s$ and voltage divider 17 consisting of resistors R1 and R2. Typically, these resistors R1 and R2 are of the same value, placing the base-line of oscillations of the resonant circuit 20 in the mid-range of the input to the analog comparator 30.

When switch S1 is closed, the oscillator circuit 20 begins to store energy as inductor 11 conducts to ground. When the inductor current has reached a desired value and the circuit 20 has stored a desired amount of energy, switch S1 is opened. When switch S1 is opened, the voltage at the + input of comparator 30 rises rapidly. This rise is limited to the supply voltage $V_s$ plus the voltage drop across the diode D1. Following this initial rise, a damped oscillation voltage waveform is observed at the + input to comparator 30 as circuit 20 oscillates at its resonant frequency determined primarily by the inductance and capacitance. The rate of damping is such that the voltage amplitude is reduced to 1/e of its initial value in $Q/2\pi$ cycles where Q is defined as $2\pi$ times the total energy stored by the resonant circuit divided by loss of energy by the circuit per cycle. See, Millman & Taub, *Pulse and Digital Circuits* (1956) Section 2–8, pp. 52 and 53.

The damping of the oscillation at the + input of comparator 30 depends on the losses of the resonant circuit 20 and the external loading of the resonant circuit 20. Coin interaction with the magnetic field of inductor 11 will load the resonant circuit 20. When a conductive coin is placed in proximity with a face of inductor 11 corresponding to either of the faces 102 or 104 of inductor 101 of FIG. 1, eddy currents are induced in the coin and $I^2R$ losses result. Therefore, the rate of damping of the oscillation circuit 20 and of the oscillation observed at the + input of comparator 30 is an indication of the degree of coin proximity to one of the faces of inductor 11.

The circuitry to the right of line I—I of FIG. 2 measures the rate of damping of the oscillation of the resonant circuit 20 and produces a signal indicative of coin presence of absence from the region near one of the faces of inductor 11. This signal is produced as follows. A reference voltage is applied to the − input of the comparator 30 by connecting the − input to a voltage divider consisting of resistors R3 and R4. This reference voltage is adjusted by appropriate selection of R3 and R4 to some voltage lower than the maximum amplitude of the damped oscillation. The output of comparator 30 is high whenever the voltage amplitude of the signal at its + input is greater than the reference voltage at its − input. Thus, each time a cycle of the oscillation at the + input of comparator 30 rises to an amplitude greater than the reference voltage, comparator 30 has a high output. Since the waveform at the + input of comparator 30 is a damped oscillation, a series of pulses is produced on line 31 at the output of comparator 30. The series of pulses on line 31 begins when the oscillation first rises above the reference voltage and ends when the oscillation ceases to rise above the reference voltage. The series of pulses on line 31 are counted by a counter 40. The output of the counter 40 is a signal (sensor count) indicative of the number of pulses counted. This signal is connected to an input of a comparator 50. A digital storage means 60 is connected to the other input of the comparator 50 and provides a reference number indicative of some predetermined fraction or percentage of the number of pulses which would be counted under some predetermined conditions, for example, when the inductor 11 is isolated from coin presence.

Since coin proximity to a face of inductor 11 increases the losses per cycle of circuit 20, the Q of circuit 20 is decreased by coin proximity to inductor 11. Consequently, coin proximity to inductor 11 increases the rate of damping of the oscillation of circuit 20 and decreases the number of cycles occurring before the amplitude of the oscillation drops below the reference voltage. Counter 40 produces a maximum sensor count signal when no coin is near inductor 11. In one embodiment, the reference number stored in storage unit 60 is less than this maximum sensor count signal but greater than the decreased sensor count produced when a coin is proximate to inductor 11. When the sensor count exceeds the reference count, comparator 50 produces a signal indicating that a coin is not present near the faces of inductor 11. If the reference count exceeds the sensor count, comparator 50 produces an output indicating that a coin is present near a face of inductor 11.

Figure 8A:
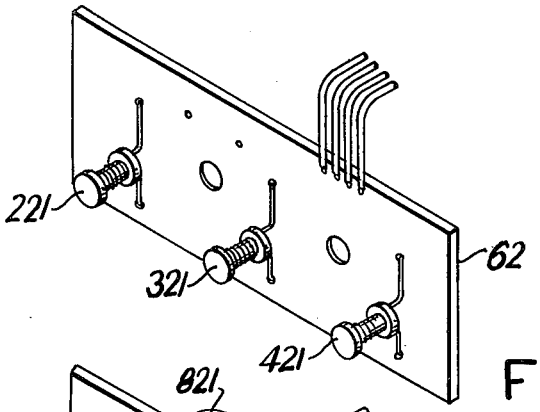
FIGS. 8A and 8B illustrate the mounting of the inductors on sensor boards for use in an apparatus according to the second embodiment of our invention.
Figure 8B:
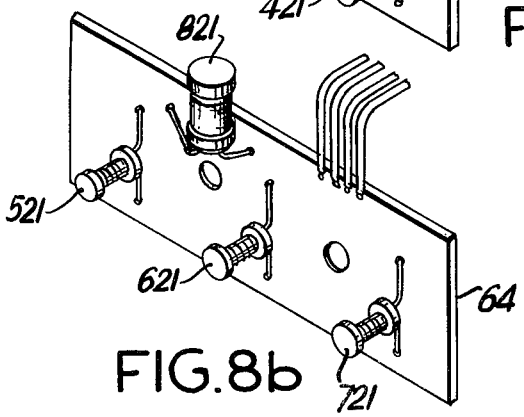
Figure 9:
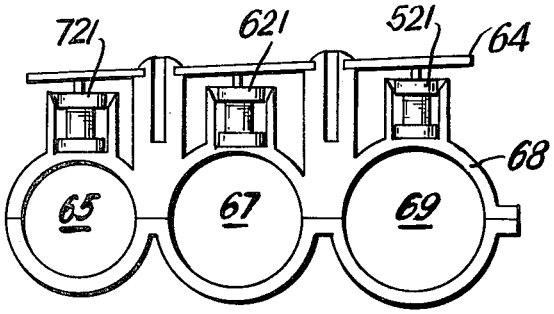
FIG. 9 illustrates the mounting of one sensor board and three inductors with relation to the back section of three coin tubes for use in apparatus according to the first and second embodiments of our invention.
Figure 10:
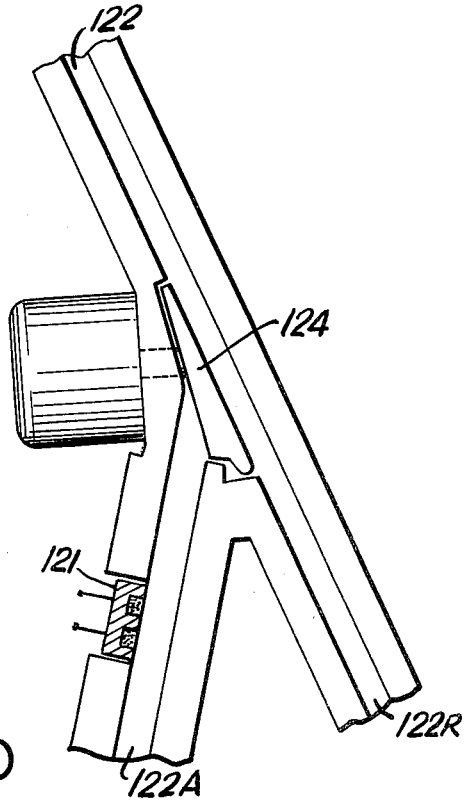
FIG. 10 illustrates the mounting of an inductor for use in apparatus according to the first and second embodiments of our invention.

Suitable means for mounting inductor 11 so that the apparatus of FIG. 2 can be used for coin tube level sensing or for coin passage sensing are shown in FIGS. 8, 9 and 10 respectively. These figures are discussed below.

Figure 3:
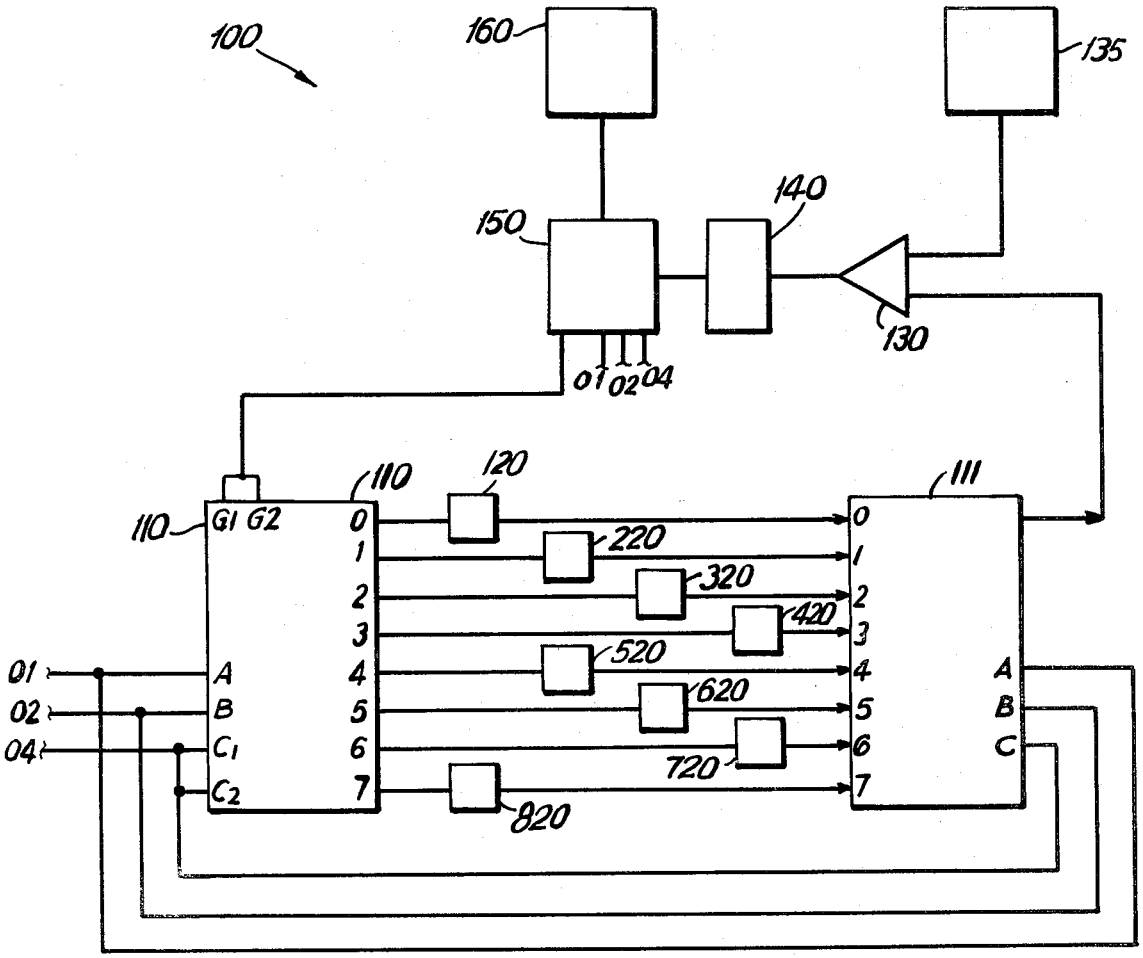
FIG. 3 shows a schematic block diagram of a second embodiment of our invention.

FIG. 3 is a schematic block diagram of the circuit 100 of a second embodiment of coin presence sensing apparatus according to the invention. In this embodiment, seven coin sensor circuits 120, 220, 320, 420, 520, 620 and 720 and a reference sensor circuit 820 are used. The sensor circuits 120, 220, 320, 420, 520, 620 and 720, shown as blocks in FIG. 3, each include an inductor for monitoring coin passage or coin tube level. Sensor circuit 120 serves as a coin passage sensor; sensors 220, 320, 420, 520, 620 and 720 serve as coin tube level sensors; and sensor circuit 820 serves as a reference sensor. The circuit 100 also includes a pulse counter 140, a logic circuit 150 and a storage memory 160.

Figure 4:
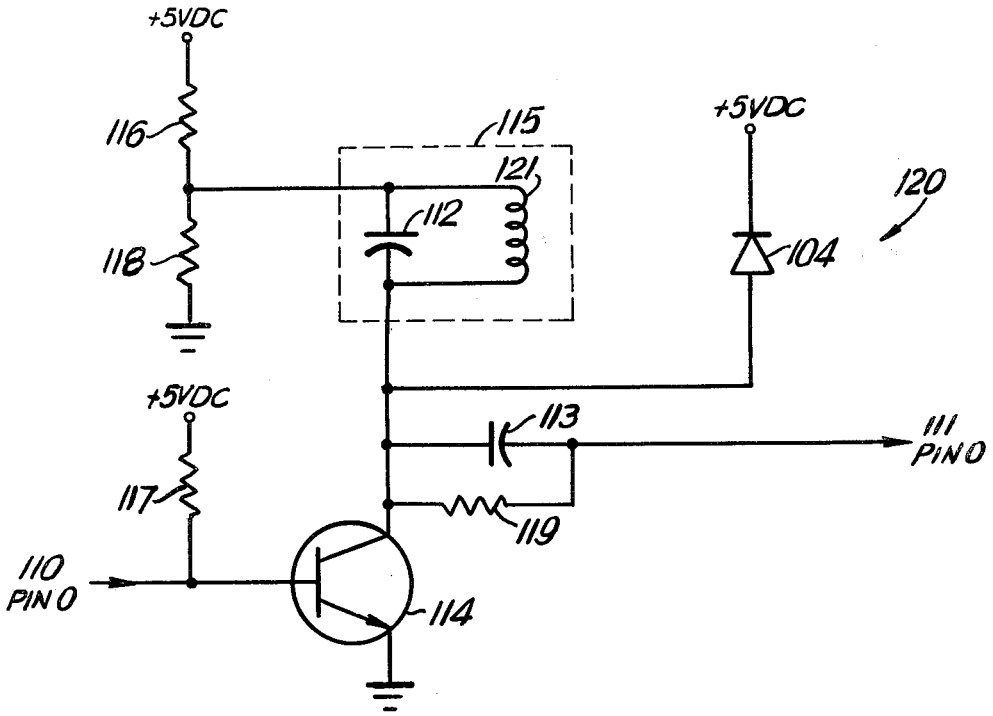
FIG. 4 shows in detail a coin passage sensor circuit for use in an apparatus according to the second embodiment of our invention.
Figure 5:
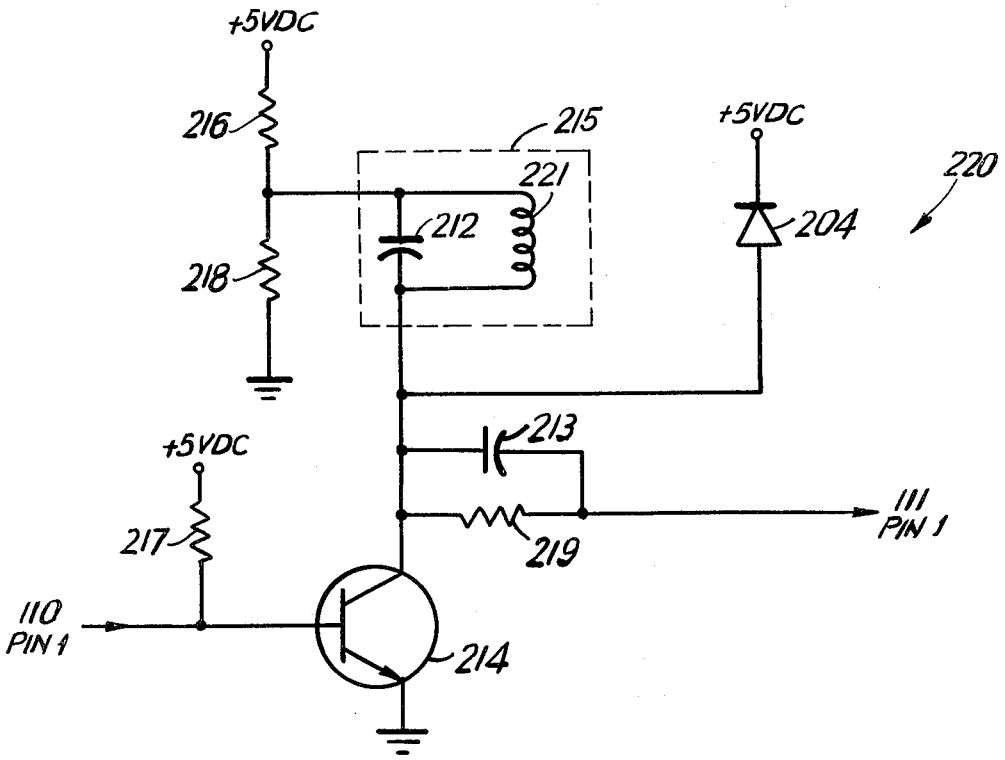
FIG. 5 shows in detail a coin tube sensor circuit for use in an apparatus according to the second embodiment of our invention.
Figure 6:
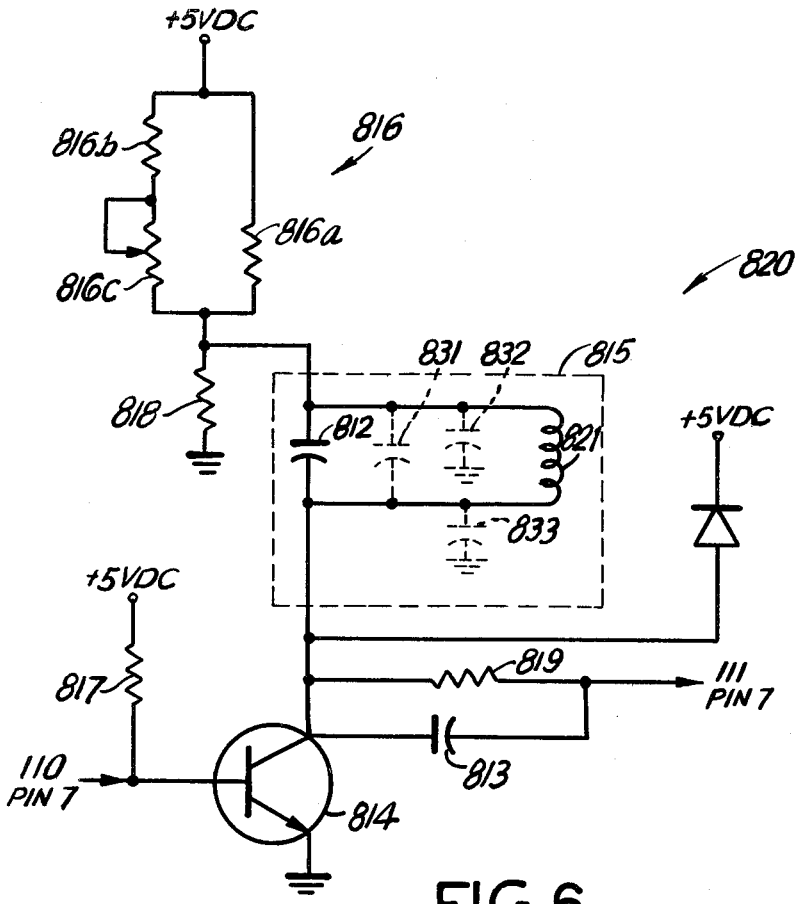
FIG. 6 shows in detail a reference sensor circuit for use in an apparatus according to the second embodiment of our invention.

All of the sensor circuits, except possibly the coin passage sensor circuit 120, have inductors of the type generally shown and discussed in connection with FIG. 1. Suitable sensor circuits 120, 220 (typical of circuits 220–720) and 820 are shown in FIGS. 4–6, respectively. Typical component values for these sensor circuits are set forth below:

TABLE I

| Coin Passage Sensor Circuit 120 | | |
|---|---|---|
| Resistors | 116 | 1 k |
| | 117 | 10 k |
| | 118 | 1 k |
| | 119 | 1 M |
| Capacitor | 112 | 2700 pF |
| | 113 | 560 pF |
| Inductor | 121 | 4 mH |
| Diode | 104 | 1N4148 |
| Transistor | 114 | 2N3563 or equivalent |

TABLE II

| Coin Tube Sensor Circuit 220 | | |
|---|---|---|
| Resistors | 216 | 1 k |
| | 217 | 10 k |
| | 218 | 1 k |
| | 219 | 1 M |
| Capacitor | 212 | 1000 pF |
| | 213 | 180 pF |
| Inductor | 221 | 10 mH |
| Diode | 204 | 1N4148 |
| Transistor | 214 | 2N3563 or equivalent |

TABLE III

| Reference Sensor Circuit 820 | | |
|---|---|---|
| Resistors | 816a | 1 k |
| | 816b | 1 k |
| | 816c | 50 k(adj.) |
| | 817 | 1 k |
| | 818 | 1 k |
| | 819 | 1 M |
| Capacitor | 812 | 1000 pF |
| | 813 | 180 pF |
| Inductor | 821 | 10 mH |
| Diode | 804 | 1N4148 |
| Transistor | 814 | 2N3563 or equivalent |

In circuit 820 of FIG. 6, capacitances 831, 832 and 833 represent capacitances which may be necessary to compensate for the fact that circuit 820 has less stray capacitance than the sensor circuits 120, . . . ,720 because it does not require as long leads to the inductors.

A discussion of the selection and operation of the coin tube level sensor 220 will illustrate the principles of operation of all eight sensor circuits 120, . . . ,820 and the circuit 100. The sensor circuits 120, . . . ,820 are connected between two multiplexers 110 and 111, shown in FIG. 3. Sensor circuit selection occurs in the following manner. Multiplexer 110, such as a National Semiconductor type 74156, is connected as a three line-to-eight line decoder and is controlled by the signals applied to pins A, B, $C_1$, $C_2$, $G_1$ and $G_2$ in conventional fashion. When the inputs to pins $G_1$ and $G_2$ are both low, the binary signal inputs on lines 01, 02 and 04 to pins A, B, $C_1$ and $C_2$ will determine which of the eight outputs is low. Multiplexer 111, such as an RCA type 4051, on the other hand is connected to select one of its eight inputs as the output and is controlled by the signals applied to pins A, B and C.

As shown in FIG. 3, the same signals are applied to the pins A, B, $C_1$ and $C_2$ ($C_1$ and $C_2$ are connected together) of multiplexer 110 and pins A, B, and C of multiplexer 111. Control signals on lines 01, 02 and 04 may be produced by a logic circuit 150 which can be a hardwired logic circuit or a programmed data processor, such as a microprocessor, or other logic circuit capable of performing the required functions as outlined herein. An Intel 8748 microprocessor is suitable for use as the logic circuit in this embodiment.

In this embodiment, the resonant or tank circuits 115, . . . ,815 of the sensor circuits 120, . . . ,820 are maintained in an energized state when not in use by holding the outputs 0–7 of the input multiplexer 110 low. This prevents ringing of non-selected tank circuits, which might occur as a result of coupling when one of the sensor circuits is selected and its tank circuit is rung.

In order to explain the typical operation of the sensor circuits 120, . . . ,720, we assume that one of them—a coin tube sensor circuit 220—has been selected. This is done by causing output 1 of the input multiplexer 110 to switch from low level (ground) to high level (open circuit). The output multiplexer 111 is simultaneously switched to accept only the output of sensor circuit 220 on the output multiplexer's input 1. Referring now to FIG. 5, the voltage at output 1 of multiplexer 110 rises rapidly after that output is switched from low level to high level, causing transistor 214 to switch off. A diode clamp consisting of a diode 204 and voltage supply (here 5 VDC) limits the rise to the supply voltage plus the voltage drop across the diode 204, a total of 5.7 VDC in this case. This limiting prevents the forward biasing and conduction of input 1 of multiplexer 111, and is also used to limit the amplitude of oscillation to a maximum voltage which is compatible with circuitry used in other parts of the apparatus 100.

When output 1 of multiplexer 110 switches from ground to an open circuit (i.e. the drive is removed), the field in inductor 221 collapses and the tank circuit 215 begins a damped oscillation. The voltage from sensor circuit 220 to ground appears at input 1 of multiplexer 111 and is a damped oscillation around a voltage determined by a voltage divider consisting of resistors 216 and 218. The appropriate selection of the resistors 216 and 218 along with the appropriate selection of power supply voltage (5 VDC here) and diode 204, discussed previously, determines the maximum amplitude of the oscillation and the level around which oscillation occurs and dispenses with the need for fancy compensation circuitry. In this embodiment, divider resistors 216 and 218, as well as the corresponding resistors 116, 316, . . . ,816 and 118, 318, . . . ,818 of the other sensor circuits 120, 320, . . . ,820 are all of the same value (1k) here), so that the base-line of all oscillations is at the mid-point between the power supply rails (0 and 5 VDC here). Circuits 120, 320, . . . ,820 and their corresponding elements (see FIGS. 4 and 6) operate in the same manner as sensor circuit 220 when they are selected by the multiplexers 110 and 111.

When sensor 220 is interrogated, the output of output multiplexer 111 will follow the oscillations at the output of sensor 220. This output signal serves as one input of a comparator circuit 130. The other input of the comparator circuit 130 is a reference voltage set at a predetermined level by a reference circuit 135. The comparator circuit 130 will produce a pulse for each cycle of the oscillation at its input which reaches an amplitude greater than the reference voltage.

Figure 7:
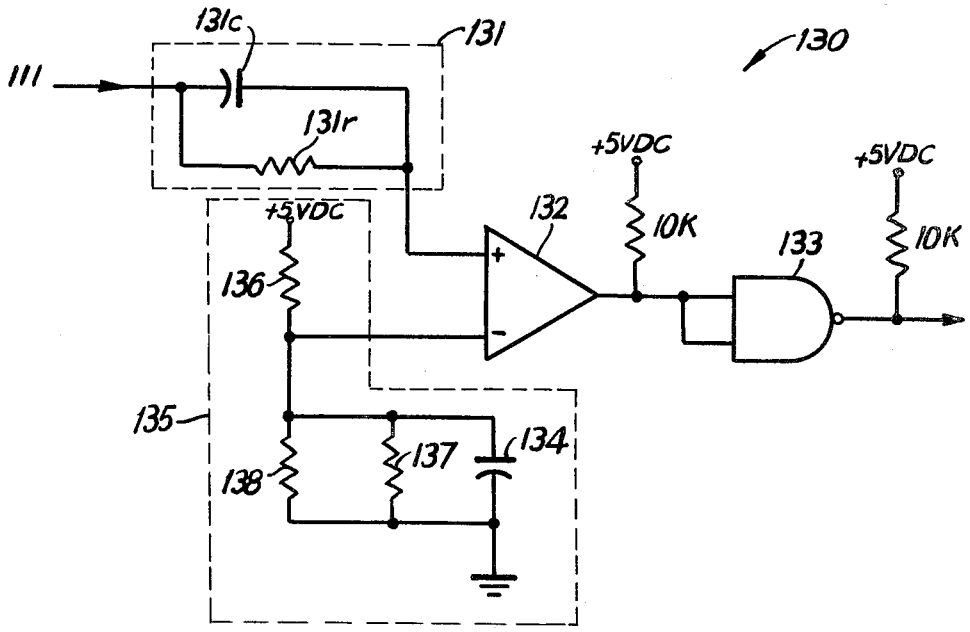
FIG. 7 shows a comparator and reference circuit for use in an apparatus according to the second embodiment of our invention.

FIG. 7 shows a circuit suitable for the comparator 130 and reference circuit 135 of the apparatus of FIG. 3. The signal from the output multiplexer 111 is received through a compensating circuit 131 and is applied to the + input of a comparator 132. A National Semiconductor type LM339 is suitable for the comparator 132. The other (−) input of the comparator 132 is connected to the reference circuit 135. This includes two resistors 136 and 138 of the same value as the divider resistors 116, . . . ,816 and 118, . . . ,818 of the sensor circuits 120, . . . ,820. In the preferred form of this embodiment, all of these resistors are 1% resistors packaged together in a resistor assembly so that they are similarly affected by the environment. A suitable resistor assembly for this embodiment is a Dale type MDP 1405102/102F. Divider resistors 136 and 138, without resistor 137, would establish the same reference level as the base line of oscillations of the sensor circuits 120, . . . ,820. Resistor 137 in parallel with one of the divider resistors, here resistor 138, reduces the resistance on that side of the divider and thereby establishes the voltage difference between the base line of oscillations and the reference value for the comparator 132. This establishes the threshold for detection of oscillation pulses by the comparator 132. A Schmitt trigger circuit inverter 133, here a NAND gate connected as an inverter, is used to sharpen the transitions of the output pulses from the comparator 132.

The pulses from the comparator 130 can be counted and compared with reference values in practically any convenient fashion. In the apparatus of FIG. 3, the pulses from comparator 130 are fed to a counter 140. At the completion of each sensor interrogation cycle, the logic circuit 150 reads out the count in the counter 140, resets the counter 140 and compares the count with the value in a storage memory 160. The value in the storage memory 160 is typically in the range of 50%–90% of the count which would be provided by one of the sensors 220, . . . ,720 in the absence of a coin. Such a value can be manually stored in the storage memory 160 or can be provided as a result of periodically interrogating the reference sensor circuit 820. When the reference sensor circuit 820 is employed, the reduced value for storage can be obtained by either multiplying the count from the reference sensor 820 by a constant (in the range of 0.5 to 0.9 in this example) or by the use of an additional resistance provided by an adjustable resistor **816*c* to offset the base line of the reference sensor circuit 820 and thereby reduce the number of oscillations from the number which would be produced, for example, by a typical coin tube sensor circuit 220, . . . ,720** in the absence of coins.

TABLE IV

| Comparator 130 and Reference Circuits 135 | | |
|---|---|---|
| Resistors | 131r | 100 k |
| | 136 | 1 k |
| | 137 | 10 k |
| Capacitor | 131c | 1000 pF |
| | 134 | .01 uF |

In one embodiment, the apparatus 100 functions as follows. The coin passage sensor 120, which has its inductor 121 adjacent the accepted coin passageway 122A as shown in FIG. 10, is interrogated frequently enough so that all coins which pass the sensor 120 are detected. Typically, after the coin is detected in a preceeding validator circuit (not shown), the reference sensor 820 is interrogated by the logic circuit 150 and a reference count is stored, and then each of the coin tube level sensors 220, 320, 420, 520, 620 and 720 is interrogated, after a suitable time delay, to determine if the addition of the detected coin has filled a coin tube or whether change which might have been required by any vending operation related to the accepted coin depletes a coin tube of sufficient coins to provide change for future vends. Operation in this fashion is advantageous for at least two reasons. First, it avoids coin tube level sensing when the vending machine is idle. Second, the use of a reference sensor subject to the same environment as the other sensors results in a reference count which reflects changes in environment in the same way that counts produced by the other sensors reflect environmental changes such as changing temperature. Other suitable methods for operation of the disclosed apparatus will be clear from the disclosure of the physical structure of the the apparatus.

FIGS. 8–10 illustrate how inductors 121–821 are mounted and also illustrate how inductor 11 shown in FIG. 2 is mounted in one embodiment. FIGS. 8A and 8B illustrate how seven of the inductors 221–821 are mounted on two sensor boards 62 and 64. Six inductors, 221–721, are part of high and low coin level sensors 220–720. These six inductors are inserted into mounting holes in the back of a coin tube wall assembly 68 as is shown for inductors 521, 621 and 721 in FIG. 9. FIG. 9 illustrates the placement of these inductors in relation to the coin tubes 65, 67 and 69. The inductors 521, 621 and 721 are each mounted so that one face projects a magnetic field into the coin tube near the bottom of the coin tube when a current is flowing in its coil. Inductors 221, 321 and 421 are similarly arranged near the tops of their respective coin tubes. An inductor 821 which is part of the reference sensor 820 is also mounted on sensor board 64. Inductor 821 is oriented so that its two faces are both effectively isolated from coins.

FIG. 10 shows the mounting of the eighth inductor 121 which is part of coin passage sensor 120. Inductor 121 is mounted adjacent accept passageway 122A which is a portion of coin passageway 122 located after acceptance gate 124. Mechanical gate 124 diverts acceptable coins along accept passageway 122A and unacceptable coins along reject passageway 122R. The details of the functioning of a mechanical coin-diverting gate like gate 124 are further discussed in U.K. application No. 79-10550 filed Mar. 26, 1979 and in U.S. Pat. No. 4,106,610. As shown in this embodiment, the field of inductor 121 is directed toward the face of passing coins and, for this reason, inductor 121 is a pot core type inductor.

We claim:

1. A coin presence sensing apparatus for sensing the presence or absence of coins in a coin passageway in a coin operated vending mechanism comprising, a first ringing type electronic oscillator circuit comprising a first inductor, said electronic oscillator circuit producing an output signal indicative of coin presence or absence in the proximity of the first inductor, the first inductor comprising a dumbbell shaped ferromagnetic core having a central core piece integrally connecting two end pieces having a larger circumference than the central core piece and a coil wound on the central core piece and between the two end pieces, the first inductor having one of its two end pieces located adjacent a first portion of the coin passageway and producing a magnetic field projecting from said one end piece into the coin passageway when current flows through the coil, and circuit means connected to the output signal of said electronic oscillator circuit for determining whether a coin is present or absent in a portion of the coin passageway in the proximity of the first inductor.

2. The coin presence sensing apparatus of claim 1 wherein the dumbbell shaped ferromagnetic core is located adjacent said first portion of the coin passageway so that the magnetic field is projected into the passageway in a direction generally parallel to the face surface of a coin when the coin is in its normal position in the passageway adjacent the first inductor.

3. The coin presence sensing apparatus of claim 1 wherein said first portion of the coin passageway comprises a portion of a coin storage tube in which coins are facially stacked for storage and wherein the dumbbell shaped ferromagnetic core is located adjacent the coin storage tube so that its magnetic field is projected into the coin tube in a direction generally parallel to the face surface of a facially stacked coin.

4. The coin presence sensing apparatus of claim 3 further comprising a second ringing type electronic oscillator circuit comprising a second inductor, said second inductor being located adjacent a second portion of the coin passageway having a generally rectangular cross-section, the smaller dimension of which is smaller than the diameter of the smallest acceptable coin to be passed by the apparatus but larger than the thickness of the thickest coin to be passed, and the largest dimension of which is larger than the diameter of the largest coin to be passed.

5. The coin presence sensing apparatus of claim 4 further comprising a single means connected to both of said electronic oscillator circuits for selectively applying a pulse to either of said electronic oscillator circuits to cause current to flow through the coil of its inductor and initiate its oscillation.

6. The coin presence sensing apparatus of claim 5, further comprising means to determine if a coin has passed the second inductor and to produce a signal indicative of coin passage by the second inductor, and control means for controlling the single means for selectively applying a pulse, said control means being responsive to the signal indicative of coin passage to control the means for selectively applying a pulse, whereby pulses are repetitively applied to the second inductor and a pulse is applied to the first inductor in response to the production of the signal indicative of coin passage by the second inductor.

7. The coin presence sensing apparatus of claim 5 wherein the circuit means is further connected to the first electronic oscillator circuit and further comprises means to determine if a coin has passed the second inductor and to produce a signal indicative of coin passage by the second inductor, and wherein the coin sensing apparatus further comprises control means for controlling the means for selectively applying a pulse said control means being responsive to the signal indicative of coin passage by the second inductor to control the means for selectively applying a pulse, whereby pulses are repetitively applied to the second inductor and a pulse is applied to the first inductor in response to the production of the signal indicative of coin passage by the second inductor.

8. The coin presence sensing apparatus of claim 1 further comprising, a second ringing type electronic oscillator circuit of the said type as the first ringing type electronic oscillator having one end of its dumbbell shaped ferromagnetic core located adjacent a second portion of the coin passageway so that a magnetic field will project into the second portion of the coin passageway when current flows through its coil.

9. The coin presence sensing apparatus of claim 8 wherein the dumbell shaped ferromagnetic core of said second electronic oscillator circuit is located adjacent said second portion of the coin passageway so that its magnetic field is projected into the passageway in a direction generally parallel to the usual position of the face surface of a coin when the coin is in the passageway adjacent the first inductor.

10. The coin presence sensing apparatus of claim 8 further comprising a single means connected to both of said electronic oscillator circuits for selectively applying a pulse to either of said electronic oscillator circuits to cause current to flow through the coil of its inductance and initiate its oscillation.

11. The coin presence sensing apparatus of claim 8 wherein at least one of the portions of the coin passageway comprises a portion of a coin storage tube in which coins are facially stacked for storage.

12. The coin presence sensing apparatus of claim 11 wherein the first inductor is located near the bottom of the coin storage tube so that its magnetic field projects into the coin storage tube at that level, and further comprising, a third ringing type oscillator circuit of the same type as the first oscillator circuit, the inductor of the third oscillator circuit being of the same type as the first inductor and being located near the top of the coin storage tube so that its magnetic field projects into the coin storage tube at that level.

13. The coin presence sensing apparatus of claim 11 wherein one of the dumbbell shaped ferromagnetic cores is located adjacent the portion of the coin tube so its magnetic field is projected into the coin tube in a direction generally parallel to the face surface of a facially stacked coin when a pulse is selectively applied to the oscillator circuit having its dumbbell shaped ferromagnetic core located adjacent the portion of the coin tube.

14. The coin presence sensing apparatus of claim 13 further comprising a single means connected to all of said electronic oscillator circuits for selectively applying a pulse to any of said electronic oscillator circuits to cause current to flow through the coil of its inductor and initiate its oscillation.

15. The coin presence sensing apparatus of claim 13 wherein the coin passageway includes one or more additional coin storage tubes, and the coin presence sensing apparatus further comprises two additional electronic oscillator circuits associated with each additional coin storage tube, each of the additional electronic oscillator circuits being of the same type as the first electronic oscillator circuit, each of the electronic oscillator circuits having an inductor of the same type as the first inductor, the inductor of one of said two additional electronic oscillator circuits being located near the bottom of each additional coin storage tube so that its magnetic field projects into the coin storage tube at that level, and the inductor of the other of said two additional electronic oscillator circuits being located near the top of each additional coin storage tube so that its magnetic field projects into the additional coin storage tube at that level.

16. The coin presence sensing apparatus of claim 15 further comprising a single means connected to all of said electronic oscillator circuits for selectively applying a pulse to any of said electronic oscillator circuits to initiate oscillation therein.

17. The coin presence sensing apparatus of claim 1 wherein the dumbbell shaped ferromagnetic core is solid and has two cylindrical ends which are joined by a cylindrical central core, the dumbbell shaped core having a total length at least 1 and ½ times the length of the cylindrical central core, and the cylindrical ends having a diameter at least 2 times the diameter of the cylindrical central core.

18. The coin presence sensing apparatus of any of claims 1–3, 4, 5–8–17 further comprising an additional ringing type electronic oscillator circuit comprising an additional inductor, the additional inductor being placed in a location in the coin operated vending machine sufficiently remote from the coin passageway that its field is not significantly affected by coins moving through the machine.

19. A coin presence sensing apparatus for use in a coin operated vending machine which has a coin accept/reject gate located along a coin passageway by which coins are alternatively directed into an accept portion of the coin passageway to a coin storage tube or into a reject portion of the coin passageway to be returned to the customer, the coin presence sensing apparatus comprising, a first ringing type electronic oscillator circuit including a first inductor adjacent the accept portion of the coin passageway for projecting a magnetic field into the accept portion of the coin passageway when the first oscillator is pulsed, a second ringing type electronic oscillator circuit including a second inductor located adjacent the coin storage tube, comprising a coil wound on a dumbbell shaped ferromagnetic core, and projecting a magnetic fluid into the coin storage tube when the second oscillator is pulsed, means for selectively applying a pulse to either the first or the second oscillator, means to determine if a coin has passed the first inductor and to produce a signal indicative of coin passage, and control means for controlling the means for selectively applying a pulse which is responsive to the signal indicative of coin passage to control the means for selectively applying a pulse, whereby pulses are repetitively applied to the first inductor and a pulse is applied to the second inductor in response to the production of the signal indicative of coin passage.

20. A coin presence sensing apparatus according to claim 19 wherein the means to determine if a coin has passed the first inductor and to produce a signal indicative of coin passage comprises means to count the oscillations of the first oscillator circuit which have an amplitude between two predetermined reference amplitudes and produce a count output, means to store a predetermined reference count, and means to compare the count output with the predetermined reference count.

21. A coin presence sensing apparatus according to claim 19 further comprising a third ringing type electronic oscillator circuit having a third inductor which is similar to the second inductor and which is located in the coin operated vending mechanism at a location remote from the coin passageway so that it is unaffected by coin presence, and means to generate a reference count from the oscillations of the third ringing type oscillator circuit, wherein the means for selectively applying a pulse also functions to selectively apply a pulse to the third oscillator.

22. A coin presence sensing apparatus for sensing the presence or absence of coins in a coin passageway in a coin operated vending machine comprising, a first ringing type electronic oscillator circuit comprising a first inductor, said electronic oscillator circuit producing an output signal indicative of coin presence or absence in the proximity of the first inductor, the first inductor comprising a dumbbell shaped ferromagnetic core having a central core piece integrally connecting two end pieces having a larger circumference than the central core piece and a coil wound on the central core piece and between the two end pieces, the first inductor having one of its two end pieces located adjacent a first portion of the coin passageway and projecting a magnetic field from said one end piece into the coin passageway when the first oscillator is pulsed and current flows through the coil, a second ringing type electronic oscillator circuit comprising a second inductor similar to the first inductor but located within the machine so that it is isolated from coin presence, said second electronic oscillator circuit producing a second output signal, means to selectively pulse the first and second oscillator circuits, and means to compare the first and second output signals and to determine whether a coin is present or absent in a portion of the coin passageway in the proximity of the first inductor.

23. A coin presence sensing apparatus for sensing the presence or absence of coins in a coin passageway in a coin operated vending mechanism comprising, means for detecting coin passage through a first portion of the coin passageway and to produce a signal indicative of coin passage, a ringing type electronic oscillator circuit comprising an inductor, said electronic oscillator circuit producing an output signal indicative of coin presence or absence in the proximity of the inductor, the inductor comprising a dumbbell shaped ferromagnetic core having a central core piece integrally connecting two end pieces having a larger circumference than the central core piece and a coil wound on the central core piece and between the two end pieces, the inductor having one of its two end pieces located adjacent a second portion of the coin passageway and producing a magnetic field projecting from said one end piece into the coin passageway when current flows through the coil, means connected to the ringing type electronic oscillator for selectively applying a pulse thereto, control means for controlling the means for selectively applying a pulse, said control means being responsive to the signal indicative of coin passage, whereby a pulse is applied to the inductor in response to the production of the signal indicative of coin passage, and circuit means connected to the output signal of the ringing type electronic oscillator for determining whether a coin is present or absent in a portion of the coin passageway in the proximity of the first inductor.

* * * * *

UNITED STATES PATENT AND TRADEMARK OFFICE

CERTIFICATE OF CORRECTION

PATENT NO. : 4,460,003

DATED : July 17, 1984

INVENTOR(S) : Elwwod E. Barnes and Thomas L. Flack

It is certified that error appears in the above—identified patent and that said Letters Patent is hereby corrected as shown below:

Col. 5, line 6, "presence of absence" should be --presence or absence--.

Col. 12, line 20, (claim 18), "claims 1-3, 4, 5-8-17" should be --claims 1-3, 4, 5, 8-17--.

Col. 12, line 44, (claim 19) "magnetic fluid" should be --magnetic field--.

Signed and Sealed this

*First* Day of *January 1985*

[SEAL]

*Attest:*

*Attesting Officer*

GERALD J. MOSSINGHOFF

*Commissioner of Patents and Trademarks*